United States Patent [19]

Dantlgraber et al.

[11] 4,257,750

[45] Mar. 24, 1981

[54] RADIAL PISTON PUMP

[75] Inventors: Jörg Dantlgraber; Horst Kramer, both of Lohr; Horst Fischer, Herne, all of Fed. Rep. of Germany

[73] Assignee: G. L. Rexroth GmbH, Lohr, Fed. Rep. of Germany

[21] Appl. No.: 30,137

[22] Filed: Apr. 16, 1979

[30] Foreign Application Priority Data

Apr. 20, 1978 [DE] Fed. Rep. of Germany ..... 2817173

[51] Int. Cl.[3] ..... F04B 1/18

[52] U.S. Cl. ..... 417/270

[58] Field of Search ..... 417/270, 273, 286

[56] References Cited

U.S. PATENT DOCUMENTS

| | | | |
|---|---|---|---|
| 2,450,248 | 9/1948 | Morgan | 417/273 |
| 2,820,415 | 1/1958 | Born | 417/252 |
| 2,948,222 | 8/1960 | Pine | 417/253 |
| 3,682,565 | 8/1972 | Yarger | 417/270 |
| 3,776,665 | 12/1973 | Dalton | 417/397 |

FOREIGN PATENT DOCUMENTS

| | | | |
|---|---|---|---|
| 1453478 | 2/1969 | Fed. Rep. of Germany | 417/270 |
| 2622010 | 5/1976 | Fed. Rep. of Germany | 417/273 |
| 2716888 | 10/1978 | Fed. Rep. of Germany | 417/273 |
| 457966 | 7/1936 | United Kingdom | 417/286 |

*Primary Examiner*—William L. Freeh

*Attorney, Agent, or Firm*—Michael J. Striker

[57] ABSTRACT

The radial pump preferably for use in connection with a hydraulic clamping device includes a plurality of pumping elements enclosed in a housing and cooperating with a corresponding pluraity of discharge valves. A multiway control valve controls the delivery of pressure fluid to a load port in such a manner that during the actuation of the load the outlet of all discharge valves are united to deliver the entire flow of pressure fluid into the load port, whereas when the load is maintained under a constant pressure, only one pumping element delivers discharged fluid via a single discharge valve into the load port and the remaining pumping elements deliver their output into the reservoir.

4 Claims, 3 Drawing Figures

RADIAL PISTON PUMP

BACKGROUND OF THE INVENTION

This invention relates generally to a radial piston pump having at least two pumping elements. More particularly, this invention relates to a radial piston pump for use in connection with hydraulic clamping devices in machine tools.

In prior-art radial piston pumps of this type, when the clamping cylinder has attained its working or clamping position, the entire flow of pressure fluid discharged from the pump has to be returned to a reservoir or tank via a pressure limiting valve so that the final working position of the clamping cylinder be maintained. Accordingly, this clamping process results in an uneconomical operation of the pump. In addition, by returning the delivered pressure fluid through the pressure limiting valve which determines the holding force for the clamping device, fluid is heated and has to be again cooled to a prescribed working temperature.

SUMMARY OF THE INVENTION

It is, therefore, a general object of the present invention to overcome the aforementioned disadvantages.

More particularly, it is an object of the invention to provide an improved radial piston pump which, particularly when applied in a clamping hydraulic system, insures an energy-saving operation.

Another object of this invention is to provide such an improved radial piston pump which is simple in structure and operation.

In keeping with these objects, and others which will become apparent hereafter, one feature of the invention resides in an axial piston pump having a plurality of discharge valves cooperating with corresponding pumping elements, in a combination comprising a first control space provided between the load port and one of the discharge valves, a multiway control valve defining a second control space and communicating at one end thereof with the first control space, a channel system including a collection channel connectable to a tank, branch channels connecting the collection channel to the remaining discharge valves, and control channels for interconnecting the first and second control spaces and the second control space to the collection channel, spring means for urging the control valve into a first switching position in which the first control space is connected via the control channels and the second control space to the collection channel, and the increased load pressure in the first control space urging the control valve against the spring means into a second switching position in which the first control space is shut off from the collection channel.

In the preferred embodiments, the control valve is either a three-way control valve or a two-way control valve. In the latter case, the two-way valve cooperates with a non-return valve connected between the first control space and a branch channel. The multiway control valve as well as the channel system are preferably made in a lateral cover member of the pump housing. The control valve is preferably a sliding spool-type valve having recessed areas delimited by the piston areas. The space in the housing and the second control space in the control valve are interconnected by one branch channel and the discharge valve is connected to the first control space adjoining the discharge port by a second transverse branch channel, both channels being also provided in the lateral cover member of the housing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
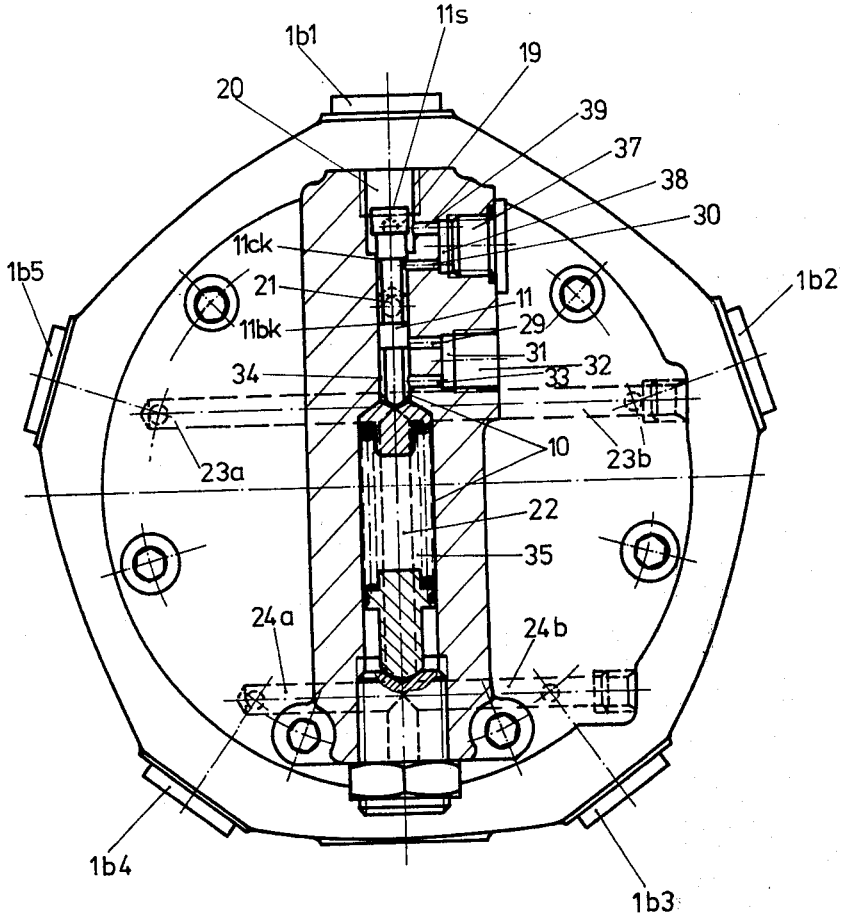
FIG. 2 is a sectional rear view taken along the line II—II of FIG. 1.

In the drawings, reference numeral 1 indicates an annular housing of the pump and reference numeral 2 denotes a lateral cover member for the pump housing. The periphery of housing 1 is provided with five uniformly distributed passages 1*a* in which, as seen from FIG. 2, are inset discharge valves 1*b*1, 1*b*2, 1*b*3, 1*b*4 and 1*b*5. A plurality of pumping elements 3 are arranged in a cylinder block 3*a* which bears against contact member 4 of respective discharge valves. The discharge valve is of any suitable design known in the art and is not described in detail. The construction and the mode of operation of the discharge valves and the pumping elements are described in the U.S. Pat. application Ser. No. 796,879. The piston of each pumping element 3 has a leg 3*b* which rests on the sliding surface of an eccenter 4'. The eccenter 4' is driven by a driving shaft 5 which is supported The shaft 5 is mounted for rotation in sleeve bearings 6 and 7 provided, respectively, in the housing 1 and in the cover 2 on both sides of the eccenter 4'. The annular space 8 enclosed by the housing and the cover acts as a suction space for the pumping elements 3 and is connected via an intake part 9 to a non-illustrated reservoir or tank.

Figure 1:
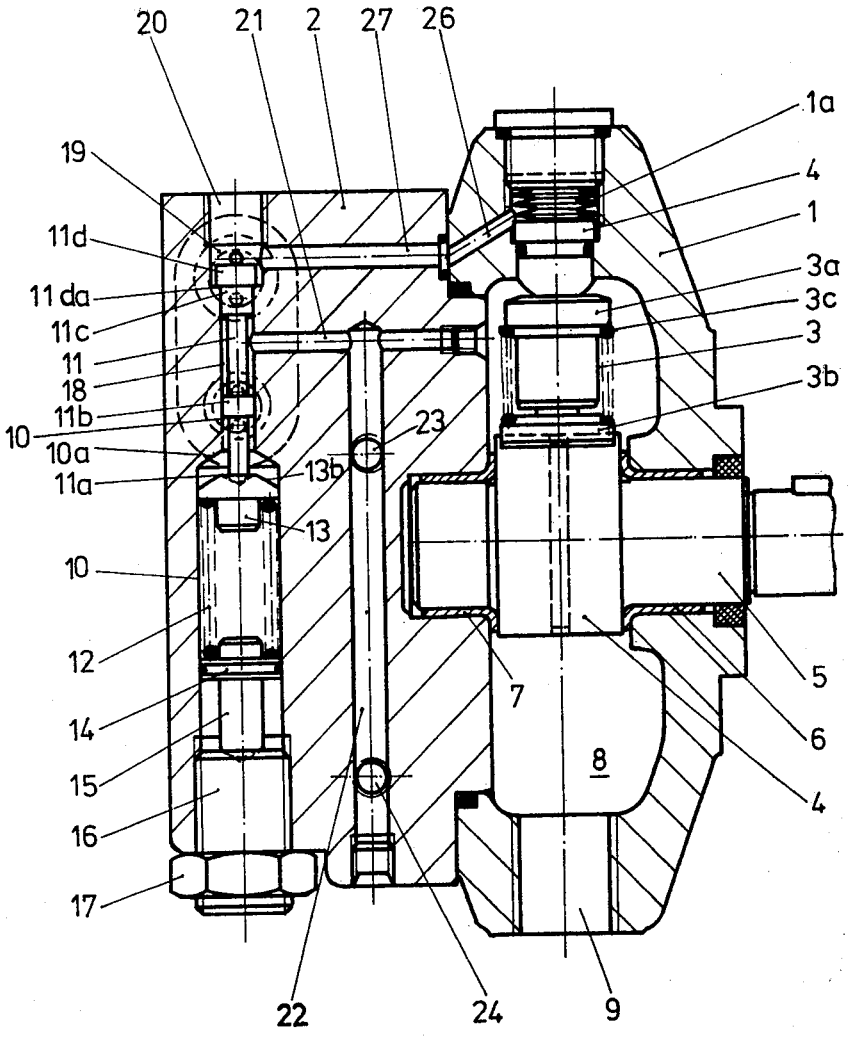
FIG. 1 is an axial section of a radial piston pump according to this invention provided with a three-way control valve.

Referring now to FIGS. 1 and 2, the cover member 2 is provided with a radially directed stepped boring 10 which accommodates a sliding spool 11 as well as a biasing spring 12 of a multiway valve. Spring 12 rests at one end on spring collar 13 provided on the lower end 11*a* of the sliding spool 11 and the other ends of spring 12 rest on spring collar 14 supported via a bolt 15 on a setting screw 16. The setting screw 16 adjusts the tension of the spring 12 and is secured against rotation by a counter nut 17. Two piston areas 11*b* and 11*c* of sliding spool 11 define in the boring 10 a control space 18, whereas the free end face 11*d* of spool 11 delimits with the discharge or load port 20 of the pump another control space 19. The cover member 2 is formed with radially directed collection channel 22 which is connected via a transverse channel 21 to the annular control space 18. The discharge sides of a part of pumping elements 3 assigned respectively to discharge valves 1*b*2–1*b*5, are connected to the collection channel 22 by additional transverse channels 23*b*, 24*b*, 24*a* and 23*a*. The channel 21, as mentioned above, connects the control space 18 between piston areas 11*b* and 11*c* to the collecting channel 22. The remaining discharge valve 1*b*1 is connected via channel 26 in the pump housing 1 and via channel 27 in the cover member 2 to the control space 19 and, consequently, is separated from the aforementioned discharge valves 1*b*2–15*b*.

Control edges 11*bk* and 11*ck* of the two piston areas 11*b* and 11*c* of the valve spool cooperate with control channels 29 and 30 (FIG. 2). The control channel 29 opens into a space 31 which directly communicates with a reservoir or tank port 32. In addition, the space 31 communicates via a channel 33 with an annular space 34 in the valve boring 10 delimited by the end face 11*a* of the sliding spool 11. This annular space 34 opens into a spring space 35 so that the latter is in a permanent connection with the reservoir port 32. The control channel 30 from the control space 18 communicates with another space 38 which is closed by a closure bolt 37 and the space 38 in turn communicates via a channel 39 with the control space 19 which in turn is directly connected to the load port 20 of the radial piston pump.

In the switching position of the multiway valve as illustrated in FIG. 2, the sliding spool 11 is shown in its starting position in which the control edge 11*bk* of control piston area 11*b* shuts off the outlet of control channel 29 whereas the control edge 11*ck* of piston area 11*c* opens the control channel 30 so that the control space 18 is connected via the channel 30, the space 30*a* and the connection channel 39 to the control space 19 and therefrom to the load port 20 of the pump. Due to the fact that channel 21 opens into the control space 18, the discharge points of the major part of pumping elements 3, formed by the discharge valve insets 1*b*2, 1*b*3, 1*b*4 and 1*b*5, are also connected via the channel 21 to the load port 20. Since the single pumping element 3 cooperating with the discharge valve inset 1*b* 1 is in the switching position as shown in FIG. 2, permanently connected via channels 26 and 27 to the load port 20, all pumping elements are now connected to the load port 20 so that the fluid discharged from the radial piston pump is supplied to a non-illustrated load such as, for example, a hydraulic cylinder, used as a clamping cylinder of a machine tool. As soon as the clamping cylinder attains its end position the load pressure increases. Since this increased pressure in the load port acts also against the face surface 11*s* of the sliding spool 11, the latter is displaced against the force of spring 12 as soon as the load pressure exceeds the biasing force of the spring 12 and the valve takes its working position as illustrated in FIG. 1.

In this working position of the control valve, control edge 11*ck* of the piston area 11*c* closes the control channel 30 and the control edge 11*bk* of the piston area 11*b* opens the control space 18 and the control space 19 is interrupted whereas the control space 18 is connected via the annular space 34 to the reservoir or tank port 32. Pumping elements 3 communicating via the discharge valves 1*b*2–1*b*5 with the channel 21 now discharge the pressurereleased fluid into the reservoir.

Only pumping element 3 assigned to the discharge valve 1*b*1 delivers as before via the channels 26 and 27 the pressure fluid into the load port 20 and maintains the delivery of the load pressure. A non-illustrated pressure limiting valve is arranged between the load port 20 and the working space of the load to maintain the working pressure in the latter. The free face 11*s* (FIG. 2) of the sliding spool 11 has a slightly larger diameter than the piston area 11*c* having the control edge 11*ck*. The resulting stop face 11*ba* limits the working or actuated position of the control valve as illustrated in FIG. 1. The starting position according to FIG. 2 is limited by the spring collar 13 which abuts with its stop surface 13*a* against the shoulder 10*a* of the stepped boring 10.

Due to the fact that the multiway control valve formed by the stepped boring 10, control channels, sliding spool 11, biasing spring 12 and setting screw 16 form together with channels 21, 22, 23*a*, 23*b*, 24*a* and 24*b* an integral part of the housing member 2 through which the communication with the discharge valve insets 1*b*2, 1*b*3, 1*b*4 1*b*5 in the pump housing is established, a particularly compact construction unit results which insures a reliable operation of the multiway control valve even at rough operating conditions.

The radial piston pump according to this invention thus operates in two pressure ranges, namely in a low pressure range and in a high pressure range. The low pressure range takes place at the starting switching position of the sliding spool 11 as shown in FIG. 2, in which the outlets of all pumping elements are connected to the discharge or load port 20. The high pressure range takes place during the working switching position of the control spool 11 shown in FIG. 1 in which only a single pumping element 3 assigned to discharge valve inset 1*b*1 contributes to the maintenance of the load pressure whereas the remaining pumping elements are connected to the tank. By virtue of this arrangement, a particularly economic operation of the radial piston pump results. Also the heating of the pressure fluid occurs in very narrow limits since only the fluid discharged from the single pumping element is delivered through the pressure limiting valve to maintain the desired load pressure whereas the fluid discharged from the remaining pumping elements flows without pressure back into the tank.

Figure 3:
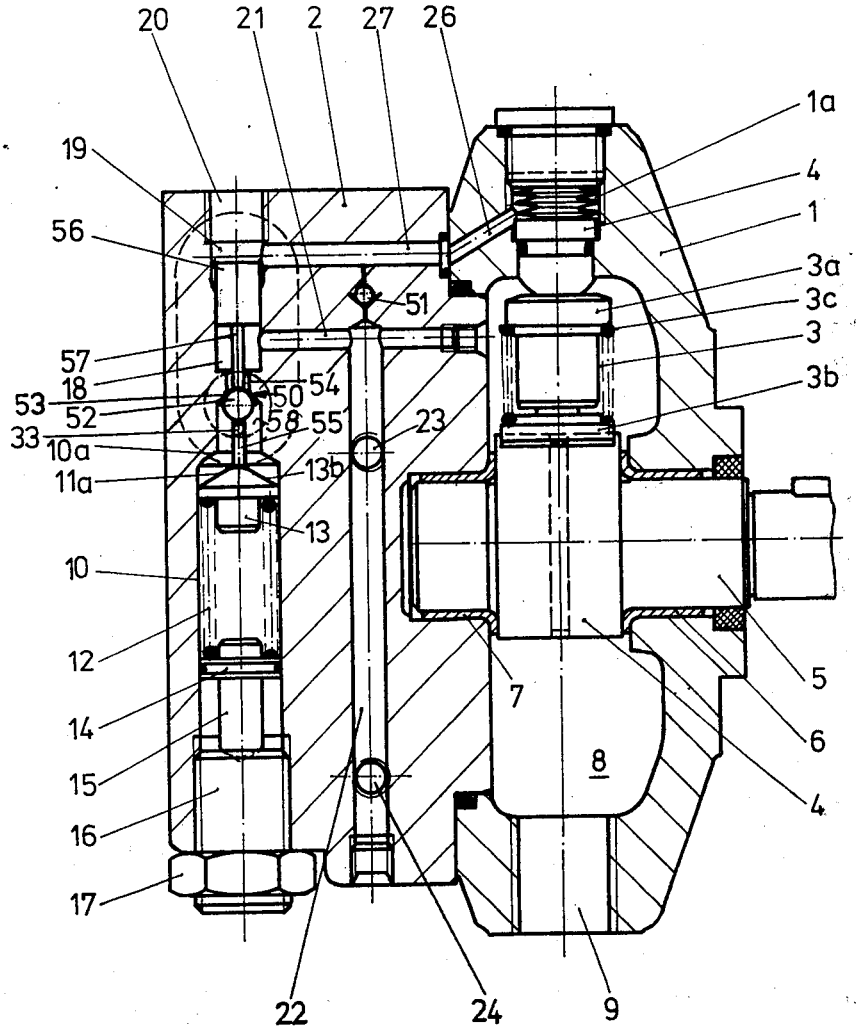
FIG. 3 is an axial section of another embodiment of the radial piston pump of this invention having a two-way control valve.

The embodiment as illustrated in FIG. 3 differs from the example according to FIGS. 1 and 2 only in the construction of the multiway switching valve 50 and in the provision of a non-return valve 51 between the channels 21 and 27. The control valve 50 is a two-way seat valve formed by a valving element 52 in the form of a ball cooperating with a valve seat 53. Boring 53 corresponding in function to the channel 34 in FIG. 2 is also connected via a channel 33 to the tank port. In the open switching position of the valving body 52, the control space 18, therefore, communicates via the channel 54 with the tank port and so do the discharge points of pumping elements 3 which are connected to the control space 18.

The pressure spring 12 acts by means of a movable spring collar 13 and an actuation pin 55 against the spherical valving body 52 and urges the same into its closing position. The open position of the valving member 52 is established by the actuation rod 57 of a piston area 56 which opens into control space 19 and is attacked through the load port 20 by the load pressure. So long as the load pressure acting against the piston area 56 is smaller than the biasing force of the pressure spring 12 acting in the opposite or closing direction, the connection between the control space 18 and the boring 58 is interrupted by the spherical valving member 52. The discharge fluid delivered by the pumping elements via the channel 21 and the collection channel 22 flows through the non-return valve 51 into the channel 27 and unites therein with the flow of the fluid delivered by the single pumping element cooperating with the discharge valve connected to this channel 27. The united flow of the entire pressure fluid is discharged through the control space 19 into the load port 20 and therefrom to the non-illustrated load such as a hydromotor. The pressure of the fluid discharged toward the load attacks in the control space 19 the piston area 56 and moves the same in the opening direction of the valving body 52. As soon as, due to the load counterpressure, the pressure of the discharged fluid in the load port increases to a value which exceeds the pressure of the biasing spring 12, the piston area 56 together with the actuation pin 57 shifts the valving body in the opening direction against the spring 12 and thus establishes a connection between the control space 18 and the channel 58 leading to the tank, the pressure of the discharged fluid delivered from the pumping element via the channel 21 into the control space 18 drops to the tank pressure. As a result of this pressure drop upstream and downstream of the non-return valve 51, the latter closes and only the fluid delivered by the single pumping element connected to the channel 27 is discharged through the load port to the load and therefrom it returns via a pressure limiting valve to the tank when the load such as a hydraulic cylinder, has reached its limit and is to be held in this position by a predetermined force. If the pressure of the fluid applied to the load is reduced, for example by reversing the working direction of the load, the force of spring 20 comes into effect and moves the valving body 52 in the closing direction and interrupts the connection between the tank and the pressure outlets pertaining to corresponding pumping elements. Consequently, a pressure starts building up upstream of the non-return valve to such an extent that the non-return valve opens in the direction of the channel 27 and the two flows of the pressure fluid from all pumping elements can again reunite in the channel 27 and flow together to the load.

In the embodiment of FIG. 3, component parts corresponding to the embodiment of FIGS. 1 and 2 are designated by like reference numerals.

It will be understood that each of the elements described above, or two or more together, may also find a useful application in other types of constructions differing from the types described above.

While the invention has been illustrated and described as embodied in a radial piston pump, it is not intended to be limited to the details shown, since various modifications and structural changes may be made without departing in any way from the spirit of the present invention.

Without further analysis, the foregoing will so fully reveal the gist of the present invention that others can by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a radial piston pump including a housing having a load port, an intake port and a plurality of discharge valves, a plurality of pumping elements arranged in said housing and cooperating with said discharge valves, a combination comprising a first control space adjoining said load port and communicating with one of said discharge valves; a multiway control valve having a piston area projecting into said first control space and defining a second control space; a channel system connecting the remaining discharge valves to said second control space and including a collection channel leading to a tank and control channels connecting said first control space to said second control space and said second control space to said collection channel; spring means for urging said control valve into a first switching position in which said first control space is connected via said control channels and said second control space to said collection channel, the increased load pressure in said first control space acting against said piston area and urging said control valve to a second switching position in which said first control space is shut off from said collection channel; said channel system including a channel connecting said first control space to said one discharge valve and branch channels connecting the remaining discharge valves to said collection channel, and said control channel cooperating with said sliding spool to separate in one switching position of the control valve said one discharge valve from the remaining discharge valves and in another switching position of said control valve, to unite all discharge valves for delivering all pressure fluid into said load port; said housing including a disconnectable closing member, and said multiway valve and said channel system being arranged in said closing member.

2. The combination as defined in claim 1, wherein said multiway control valve is a two-way control valve, and further including a non-return valve connecting the channel leading to said one pumping element to the channel leading to the remaining pumping elements.

3. The combination as defined in claim 2, wherein said two-way valve includes a seat valve, two juxtaposed piston areas acting from opposite sides via actuation pins against the valving member of said seat valve, one piston area opening into sad first control space to be attacked by the load pressure and the other piston area being spring biased in opposite direction by said spring means.

4. The combination as defined in claim 1, wherein said spring means further include adjusting means for adjusting the biasing force of said spring.

* * * * *